United States Patent [19]

Henderson

[11] Patent Number: 5,057,747

[45] Date of Patent: Oct. 15, 1991

[54] ARC LAMP STABILIZATION

[75] Inventor: Alan R. Henderson, Carlsbad, Calif.

[73] Assignee: Hughes Aircraft Company, Los Angeles, Calif.

[21] Appl. No.: 274,213

[22] Filed: Nov. 21, 1988

[51] Int. Cl.[5] ..... H05B 31/22; H05B 31/28

[52] U.S. Cl. ..... 315/158; 315/155; 315/338; 315/344; 315/346

[58] Field of Search ..... 315/152, 155, 158, 344, 315/346, 338

[56] References Cited

U.S. PATENT DOCUMENTS

| | | | |
|---|---|---|---|
| Re. 30,571 | 4/1981 | Bachur et al. | 315/158 X |
| 2,479,309 | 4/1949 | Cave-Browne-Cave | 315/346 X |
| 3,014,134 | 12/1961 | Bower | 315/155 X |
| 4,417,179 | 11/1983 | Fujimura et al. | 315/158 X |
| 4,467,246 | 8/1984 | Tanaka et al. | 315/158 |
| 4,630,182 | 12/1986 | Moroi et al. | 362/345 X |
| 4,871,947 | 10/1989 | Miyashita et al. | 315/344 |

*Primary Examiner*—Eugene R. LaRoche
*Assistant Examiner*—Do Hyun Yoo
*Attorney, Agent, or Firm*—Terje Gudmestad; Wanda K. Denson-Low

[57] ABSTRACT

Arc lamp output stability is improved by use of negative feedback which stabilizes arc position and intensity. Position and intensity of an image of the arc are sensed by optical sensors to control electromagnets which shift arc position so as to decrease wander and to control lamp current to decrease arc intensity variation.

10 Claims, 4 Drawing Sheets

ARC LAMP STABILIZATION

BACKGROUND OF THE INVENTION

1. Field of the Invention

The present invention relates to electric arc lamps, and more particularly concerns dynamic stabilization of arc position and intensity.

2. Description of Related Art

The high intensity white light source employed by many optical systems, such as video and film projectors, is commonly produced by an electric arc lamp. The arc of such a lamp is subject to wander, that is, a random shift of the arc relative to one of the electrodes in a plane transverse to the direction in which the arc extends between the electrodes. Such arc wander causes an undesired flicker (amplitude variation) of the projected image which is sometimes masked by defocusing of the illumination source, thereby decreasing optical efficiency.

Prior arc lamps employ a pointed electrode for the cathode which burns and becomes blunt during the life of the lamp. At least partly for this reason, arc lamp output decreases considerably in the first one hundred hours of use. The cathode burnback not only causes variation of arc light intensity and arc position, but decreases lamp life and limits lamp current modulation range.

Arc lamp wander is essentially of a random nature, and cannot be specifically predicted. It may be due to a number of factors, including gas turbulence, current changes, preferential electron emitter sites on the cathode, and also external magnetic fields In the past, permanent magnets have been employed to cancel fixed external magnetic fields, but applicant is not aware of any attempt made to correct for arc wander due to other factors, such as gas turbulence, current changes and preferential electron emitter sites. No dynamic stabilization of an arc has been previously employed. Prior art has merely attempted to mask the arc wander by defocusing, or more generally, has simply tolerated the undesirable flicker.

Accordingly, it is an object of the present invention to stabilize an electric arc so as to decrease wander and intensity variation.

SUMMARY OF THE INVENTION

In carrying out principles of the present invention in accordance with a preferred embodiment thereof, displacement placement or wander of the arc is sensed, and the arc position is shifted in a sense to decrease the sensed displacement. More specifically, an image of the arc is formed on an image forming surface, position of the arc image relative to the surface is detected in order to determine deviation of the image in one direction or another, and position of the arc is electromagnetically shifted in response to sensed arc image deviation.

The arc intensity is sensed by a detector or detectors . The detector output is amplified and used to modulate the lamp current, thereby keeping the arc intensity nearly constant.

DESCRIPTION OF THE PREFERRED EMBODIMENT

In order to provide an improved, clean, convenient, high intensity light source, short-arc lamp technology has evolved as an alternative to carbon-arc systems. A short-arc lamp is characterized by an arc length of less than 10 millimeters, high fill gas pressure of several atmospheres, and a spherical envelope shape The constricted arc gap produces a very small "point" source of brilliant light. The small arc plasma area permits the use of optics specifically designed to efficiently collect and direct the intense light from these sources. Since the short-arc lamp is a better point source than either a filament, a medium or a long-arc type lamp, collection efficiencies typically exceed eighty-five percent, and reflectors can deliver more sharply focused, uniform and/or collimated beam outputs.

Figure 1:
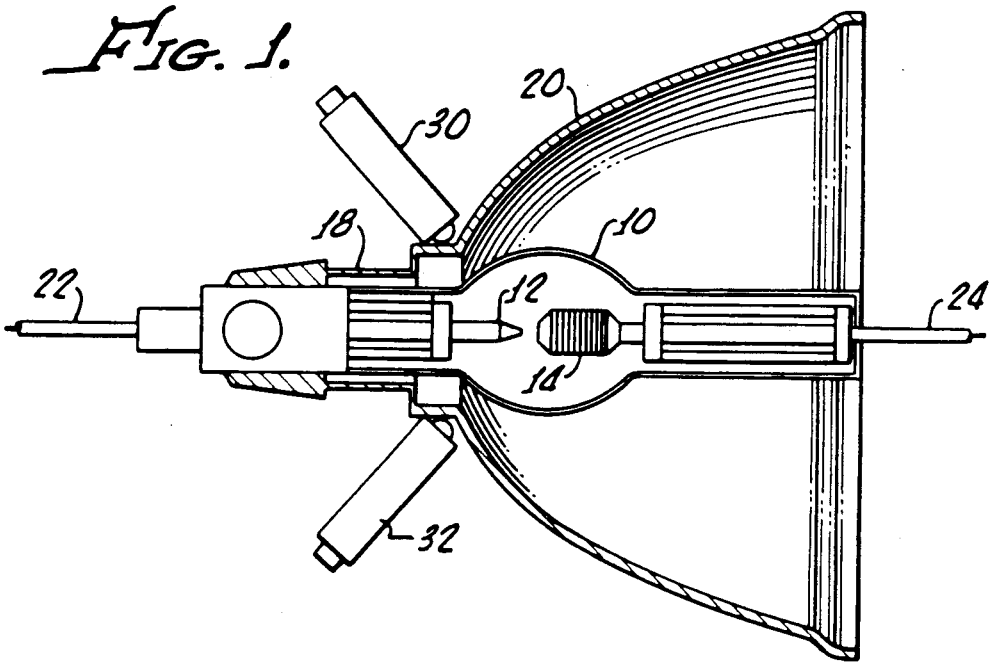
FIG. 1 illustrates a section of an exemplary electric arc lamp, illustrating some of the magnetic coils of a stabilization system of the present invention.

Illustrated in FIG. 1 is a horizontal section of an exemplary short-arc lamp modified to incorporate principles of the present invention. The lamp includes a somewhat spherical sealed envelope 10, often made of pure fused silica, and containing a xenon gas. The envelope mounts a cathode 12 and an anode 14, spaced less than 10 millimeters apart. Electrodes 12,14 are made of tungsten, which has a melting point of 3410° Centigrade, so as to withstand the nearly 1900° Centigrade and 1500° Centigrade temperatures, respectively, of cathode and anode. The cathode of prior art lamps has a sharp tip in the form of a 30 to 40° cone. However, the cathode may have a blunter tip when the lamp employs principles of the present invention. A 400 watt prior art arc lamp having a cathode diameter of about 3.556 millimeters has a sharp tip, with a radius of 0.1 millimeters or less, whereas the blunter tip used for such cathode when the lamp employs principles of the present invention has a tip radius of between 0.25 and 0.40 millimeters, and preferably about 0.35 millimeters.

The envelope 10 is potted within and sealed to a neck 18 of a roughly parabolic reflector 20, with the cathode support structure being sealed in the reflector neck so that the entire lamp envelope is effectively cantilevered from the reflector neck. Cathode and anode leads 22,24 are connected to a DC power supply (not shown in FIG. 1) which is sufficient to supply an 8 to 50 kilovolt starting pulse to break down the arc gap and then provide an open circuit voltage of 1.5 to 3 times the rated lamp operating voltage with a wide band current control negative feedback loop, so as to heat the cathode to thermionic emission temperatures. An exemplary power supply may be a pulse width modulated DC supply having provision for regulation of current. The radiation spectrum of the xenon arc plasma is a continuum from ultraviolet to far infrared, including a very bright white output in the visible spectrum.

Except for the blunter cathode tip, arc construction details described to this point are set forth only as an example of a known arc lamp construction. A typical arc lamp substantially identical to that described above (except for the blunter tip) is made by the Optical Radiation Corporation Lamp Division of Azusa, Calif.

The arc produced by the short arc lamp extends in a direction generally from the tip of the cathode to the anode, parallel to the reflector axis, in the arrangement shown in FIG. 1. Brightness and radiance of the arc are at a maximum at the cathode tip. The brightness and radiance decrease toward the anode with a dark space at the anode surface. Generally, the nearly point source of such a short arc lamp exists substantially at the cathode tip. The position of this point source, the area of maximum brightness and radiance, tends to move somewhat relative to the pointed cathode. In particular, as the prior art pointed tip is subject to burnback and becomes less pointed and more blunt, the point source of high brightness of the arc tends to wander randomly in different transverse directions in a plane perpendicular to a line from the cathode to the anode. This is the arc lamp "wander", previously mentioned, which causes flicker or requires illumination source defocusing, and which, in many situations, may not be acceptable.

According to principles of the present invention, wander of the arc is instantaneously sensed optically, and a feedback signal is developed representing sensed instantaneous displacement of the arc relative to the cathode axis. Feedback signals are applied to a set of two pairs of electromagnetic coils, of which coils 30,32 of one pair are illustrated in FIG. 1. All of the coils are fixedly mounted by suitable means (not shown) with respect to the reflector 20, so as to be fixedly positioned close to the lamp electrodes.

In order to sense arc wander, an image of a small amount of arc energy with a pattern that indicates arc position is obtained. Such an image of the arc and its position relative to the electrodes may be obtained in many ways, dependent on arc lamp application and the optical system design. A presently preferred method for obtaining such an image is illustrated in FIG. 3 and will be described below. Such an arc image, obtained for dynamic arc stabilization according to principles of this invention, is illustrated at 36 in FIG. 2.

Figure 2:
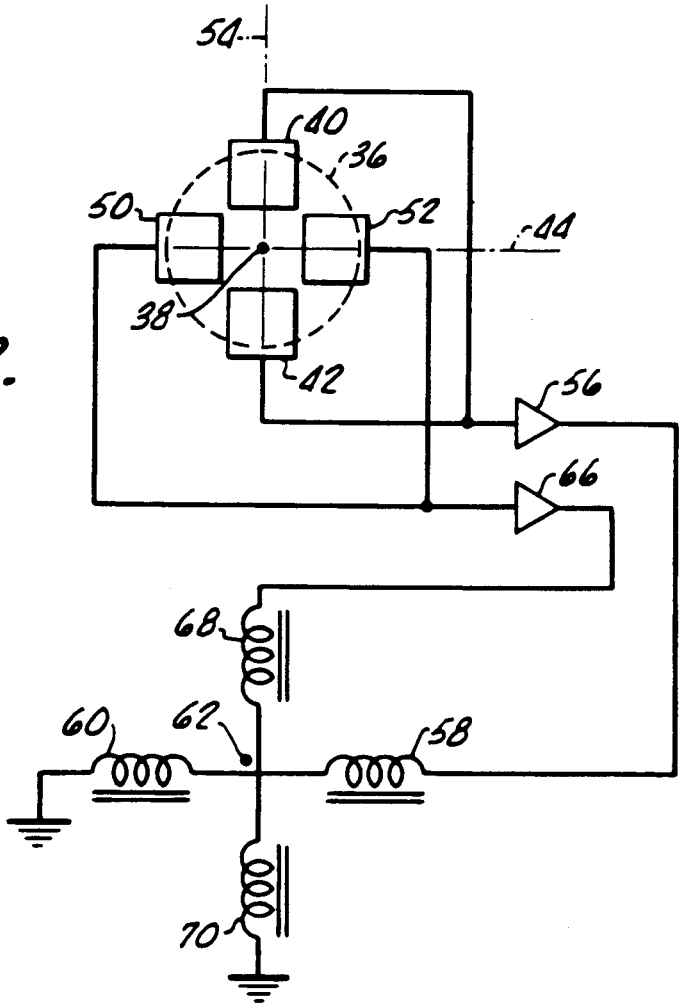
FIG. 2 schematically depicts arc image position sensing and electromagnetic arc position correction.
Figure 3:
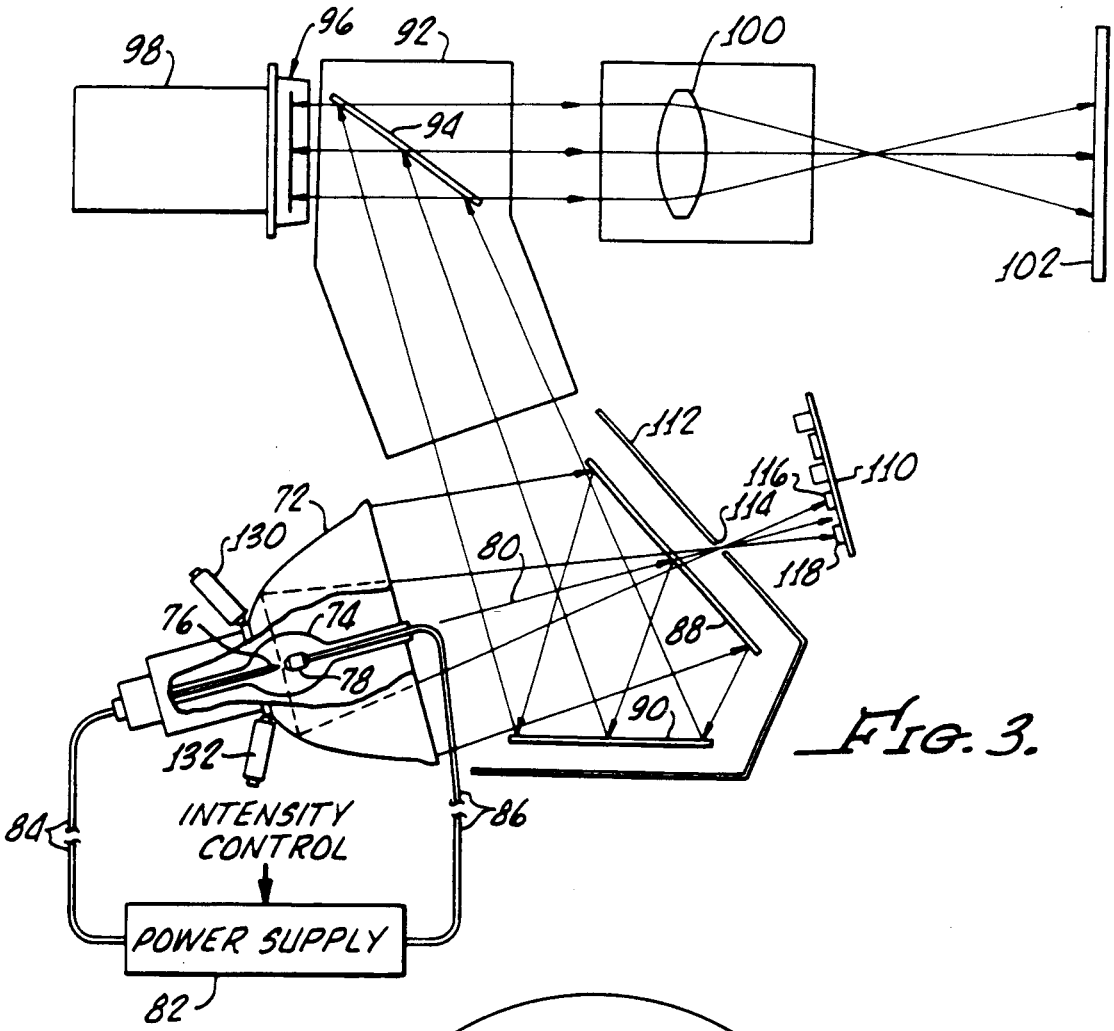
FIG. 3 shows the configuration and relative positions, as viewed from the top, of basic components of an exemplary liquid crystal light valve projector incorporating dynamic arc lamp stabilization principles of the present invention.

FIG. 2 schematically illustrates an image 36 of the arc lamp and its reflector 20, showing the electrodes as a dark spot 38 at the center of the image. The image is formed on a fixed image surface which contains photo diodes 40, 42, 50 and 52. A first pair of optical sensors, such as photo diodes 40,42, is fixedly positioned relative to the image surface to sense intensity of illumination of the image in the upper half of the image (above a horizontal line of symmetry 44, for example) and in the lower half of the image (below the line 44), respectively. A second pair of optical sensors, such as photo diodes 50,52, is positioned to detect image intensity in, for example, the left half of the arc lamp image (to the left of a vertical line of symmetry 54) and in the right half of the image (to the right of line 54), respectively. For purposes of exposition, assume the image 36 is in a vertical plane perpendicular to the direction of the arc from cathode to anode. Should arc wander cause the arc to move upwardly, for example the intensity of the arc image detected by diode 40 becomes greater than that detected by diode 42. In other words, the total illumination received by one diode from its fixed field of view of the image surface becomes greater than the total illumination received by the other, because of a shift of the image relative to the fixed diodes. The two diode outputs are differentially combined at the input to an amplifier 56, of which the output is fed to a pair of electromagnetic coils 58,60, positioned close to the arc in alignment with one another but on opposite sides of the arc axis. The arc axis is schematically illustrated in FIG. 2 by the dot 62. Coils 58,60 are positioned so that when a south pole of coil 58 is at the end of the coil closer to the arc axis 62, the north pole of coil 60 is at the end of this coil closer to the arc. Thus the magnetic fields of the two coils are additive, and, of course, will displace the arc. The arrangement of the coils with opposite poles adjacent to the arc results in both magnetic flux addition and good flux linearity in the vicinity of the arc. However, the displacement of the arc caused by coils, such as coils 58 and 60, which provide a horizontally directed magnetic field, will act on the arc axis in such a manner as to displace the arc vertically. Similarly, a vertically directed magnetic field will exert a horizontal deflection force on the arc.

The individual outputs of the second pair of light sensors 50,52 are differentially combined at the input of an amplifier 66 and fed to a second pair of similarly poled electromagnetic coils 68,70, connected in series, as are the coils 58,60. Coils 68,70, like the pair 58,60, are fixedly positioned relative to the reflector 20 and the arc electrodes, and at points close to the arc. Coils 58,60 of FIG. 2 correspond to the devices 30,32 of FIG. 1, both functionally and structurally. In the simplified exemplary system illustrated in FIG. 2, the sensors are arranged to sense intensity of upper and lower and right and left halves of the arc image, and their coils are similarly arranged in horizontal and vertical pairs. These orientations of the sensors and electromagnetic devices are disclosed solely for purposes of exposition. It will be readily understood that the sensor pairs and electromagnetic coil pairs may be positioned at different angles to the vertical and at various orientations, provided only that each sensor pair is oriented in a manner corresponding to the orientation of its corresponding electromagnetic coil. If the electric arc is at a center or reference position, the diodes of each sensor pair, such as diodes 40,42, for example, will receive equal illumination, their differentially combined output is zero, and zero coil current results. If the arc shifts from its center or reference position, at least one pair of sensors receive unbalanced amounts of illumination. Unequal illumination to the sensors of one pair provides a differential feedback signal from one of the amplifiers 56,66 which causes a current flow direction in the appropriate coil pair such that the magnetic field generated thereby causes the arc to move toward the position where the sensors for that pair of coils are equally illuminated. This is a negative feedback loop employing high gain amplifiers, and thus results in a very stable arc position. Effectively the sensors develop an arc position signal representing displacement of the arc from a reference position, and this signal is employed in a negative feedback loop to move the arc in a direction tending to decrease sensed arc displacement. Sensors on each sensor axis are identical to (except for orientation) and independent of sensors on the other axis. The same is true of the two pairs of coils. Depending on the size of the arc image 36, the individual sensors 40, 42, 50 and 52 may be either single photo diodes or suitably positioned arrays of photo diodes. Where arrays of photo diodes are used, the outputs of opposite diodes of individual arrays will be summed to provide a feedback signal for the direction of the straight line passing through the centers of the diodes.

Illustrated in FIG. 3 is an exemplary projection system employing principles of the present invention for dynamic arc position stabilization. A reflector 72 mounts an arc lamp 74, having electrodes in the form of a cathode 76 and an anode 78 aligned along a reflector axis 80 and provided with electrical power from a DC power supply 82 via cables 84,86, which are connected to the cathode and anode respectively. Power supply 82 may be a pulse width modulated supply having a duty cycle that can be varied to vary the current supplied to the arc. Energy radiated from the arc, having a brightest spot at the tip of the cathode 76, is reflected from the interior surface of reflector 72 to a second fixed reflector in the form of a first cold mirror 88 The cold mirror is a dichroic mirror having suitable coatings that cause the mirror to reflect energy in the visual region but to transmit infrared energy. Thus the second reflector 88 basically separates energy radiated from reflector 72 into energy of two different wavelength bands Energy in the band of visible wavelengths is reflected from reflector 88, and infrared energy is transmitted by the reflector 88.

Energy reflected by the reflector 88 is reflected from a third fixed reflector 90, which is also a cold mirror, reflecting visual energy and transmitting infrared energy. Energy reflected from the third reflector is fed to a fixed beam splitting polarizing prism, such as a Mac Neille Prism 92, having a reflector plate 94 embedded therein. Visual energy from cold mirror 90 is reflected from the surface of embedded reflector 94 to a fixed liquid crystal light valve 96. The liquid crystal light valve 96 is a device which reflects, with suitable polarization, light that it receives from its forward surface (that facing reflector 94) in accordance with a pattern of light received upon its rear surface (that facing a cathode ray tube 98 that is mounted behind the liquid crystal light valve). Thus the light valve will reflect light impinging upon its forward surface in a pattern that matches the pattern of light received at its rear surface. Light reflected from the light valve 96, being derived from the very high intensity arc lamp, is of considerably enhanced brightness, and thus the pattern of the display on the cathode ray tube is projected forwardly (toward the right as viewed in FIG. 3) from the liquid crystal light valve with greatly increased intensity. The light reflected from the liquid crystal light valve is an amplified version of the cathode ray tube display, but having a suitable polarization that enables it to pass through reflector 94 of the polarizing prism 92 to a projection lens 100 for illumination of a display screen 102. Details of components of such a projecting system employing a liquid crystal light valve and an embedded polarizing prism are described in the co-pending application of Eugene W. Cross, Jr. for Color Corrector For Embedded Prisms filed Dec. 22, 1987, Ser. No. 137,486, now U.S. Pat. No. 4,890,901, dated on Jan. 2, 1990 and assigned to the assignee of the present application. The disclosure of this co-pending application is incorporated in this application as though fully set forth herein.

As previously mentioned, because of wander of the arc that is struck between electrodes 76,78, areas of the desired image projected on the screen 102 may flicker. Accordingly, following principles of the present invention as described above, an image of the arc lamp reflector and electrode is caused to be projected on a portion of an electronic circuit board 110 that is fixedly mounted behind (toward the right as viewed in FIG. 3) the first cold reflector 88. Between the imaging surface of electronic circuit board 110 and cold reflector 88 is fixedly mounted a flat plate 112 of material opaque to the infrared radiation that is transmitted through the cold reflector 88. The plate 112 has a pinhole aperture 114 which acts as a lens system to focus an infrared image of the reflector 72 and its arc upon the electronic circuit board 110. Mounted on the face of the electronic circuit board 110 are a plurality of photosensitive diodes 116,118, including a first pair 116,118 corresponding to diodes 50 and 52 of FIG. 2. Also mounted on circuit board 110 is a second pair of photosensitive diodes (not seen in FIG. 3) corresponding to diodes 40,42 of FIG. 2, but lying along an axis perpendicular to or at a substantial angle to the axis extending between diodes 116 and 118. Thus the electronic circuit board has first and second pairs of diodes lying on mutually angulated, preferably orthogonal, axes. Circuit board 110 may also mount other electronic components used in the feedback and control circuitry for position and intensity stabilization of the arc.

Figure 4:
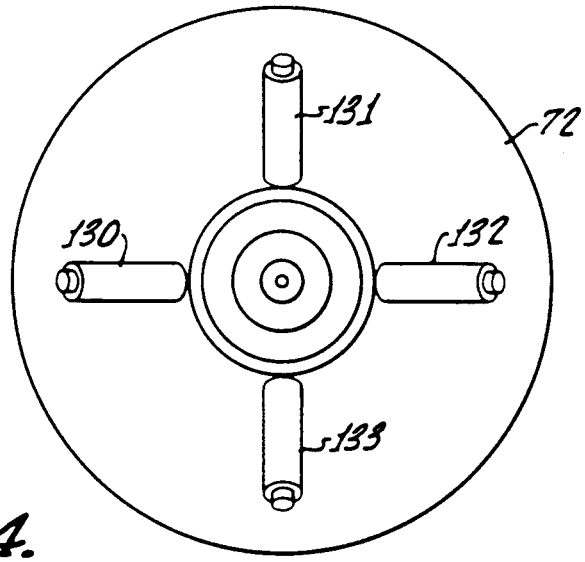
FIG. 4 is an end view of an arc lamp and reflector, illustrating location of electromagnetic arc shifting devices.

Infrared radiation of an image of the arc and electrodes is projected on the face of the electronic circuit board 110, and also on the photo diodes 116,118, and the photo diodes of the second pair of diodes (not shown). The outputs of the photo diodes of one pair of photo diodes are differentially combined in the electronic circuitry mounted on the circuit board 110 to provide a negative feedback signal representing sensed deviation of the arc from a reference position, such as the reference position of cathode 76, in a first direction lying in a plane perpendicular to the direction of the arc from cathode to anode. This feedback signal is amplified in the high gain amplifier (such as amplifier 56 or 66 of FIG. 2) and fed to a pair of similarly poled electromagnetic coils 130,132 (FIGS. 3 and 4), which are counterparts of coils 30 and 32 of FIG. 1 and of coils 58 and 60 of FIG. 2. It will be understood that the coils are shown in the positions illustrated in FIGS. 3 and 4 solely for purposes of illustration. As previously mentioned, deviation in a horizontal direction, such as would be sensed by diodes in the position of diodes 116 and 118 of FIG. 3, will be fed to coils that produce an electromagnetic field extending in a substantially vertical direction perpendicular to the direction of the arc from electrode 76 to anode 78. In other words, for a sensed deflection of the arc image in the direction of the circuit board from diode 116 toward diode 118, that is, an image deflection which may be termed a left to right horizontal deflection, arc position correction will be achieved by producing a substantially vertical correcting magnetic field at the arc that is effectively perpendicular to the plane of the paper, as viewed in FIG. 3. Such vertically directed magnetic field will effect a net horizontal deflection of the arc. Similarly, for the other pair of diodes (not shown) on circuit board 110, a second pair of electromagnetic coils 130,132 (FIG. 4) aligned along an axis that is transverse to the axis of the coils 131,133, is positioned in fixed relation to the arc and to the electrodes and reflector and receives a negative feedback signal to create a magnetic field that tends to return the arc to its reference or central position and to decrease its sensed displacement. It will be readily understood that the four electromagnetic coils may be mounted in any suitable manner as long as they are positioned as described herein and fixedly related to the reflector and electrodes. Similarly, the circuit board 110, reflectors 88 and 90, and apertured plate 112 are also mounted in relatively fixed position and orientation so that the position of these elements and, for example, the pin hole 114 and its relation to the imaging surface of electronic circuit board 110 will provide appropriate information for optical sensing of the arc position and displacement.

Figure 5A:
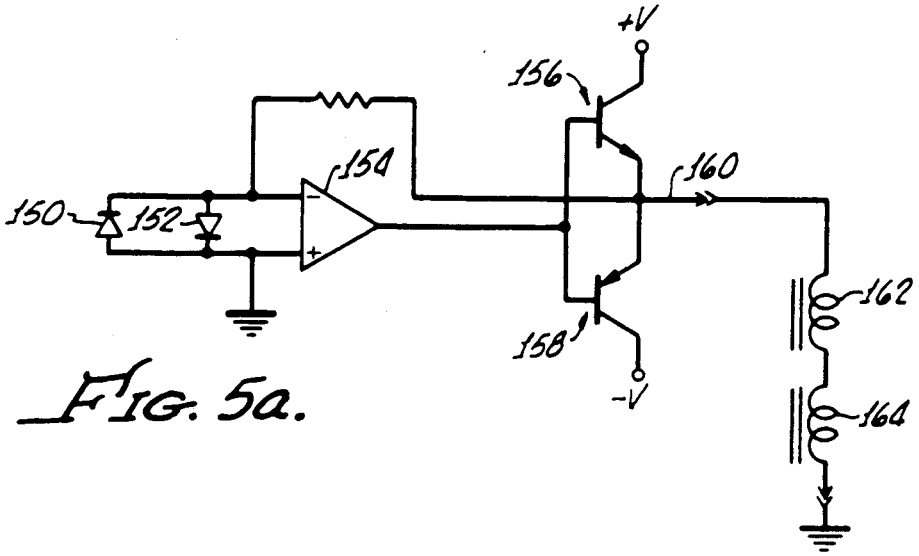
FIGS. 5*a*, 5*b* and 5*c* illustrate simplified circuitry of optical sensors and electromagnetic positioning feedback applied for stabilization and intensity control.

FIG. 5*a* illustrates circuitry for one of the pair of arc position controlling feedback signals, showing, for example, a first pair of photo diodes 150,152 having their outputs differentially connected to the inverting input of a high gain differential amplifier 154, which has its non-inverting input grounded The amplifier output is fed in parallel to the base electrode of each of a pair of transistors 156,158, connected in a common emitter configuration and having a common emitter output lead 160 on which appears the feedback signal representing the difference between the outputs of diodes 150,152. This feedback signal is fed to a first pair of serially connected electromagnetic coils 162,164, as previously described, to provide a magnetic force acting on the arc in a sense that tends to decrease the sensed arc displacement. This magnetic force displaces the arc so as to tend to equalize the infrared energy received by the pair of photo diodes 150,152. Amplifier stabilizing feedback is provided from the common emitters of transistors 156,158 to the inverting input of amplifier 154.

Similarly (FIG. 5*b*) a second pair of diodes 170,172 mounted on the other axis of the arc and reflector image are differentially connected together and to the inverting input of a high gain amplifier 174 which has its noninverting input grounded. The output of amplifier 174 is fed in parallel to the bases of a pair of transistors 176,178, connected in a common emitter configuration and producing a feedback signal provided on an output line 180 connected to the common emitters. The feedback signal on line 180 is fed to a pair of electromagnetic coils 182,184 that displace the arc so as to tend to equalize the energy sensed by the two diodes 170,172. Amplifier stabilization is provided by feedback from the common emitters of the transistors to the inverting input of the amplifier 174.

For stabilization of arc lamp brightness or intensity an intensity sensing photo diode 190 is mounted on the circuit board 110 in a position to detect intensity of a substantially centralized area of the infrared image of the arc lamp and reflector 72. The output of this photo diode 190 is fed to the inverting input of a high gain differential amplifier 192, having its non-inverting input grounded. The amplifier output is compared to a brightness command signal provided on an input line 194 via an adjustment potentiometer 196. The difference between the sensed brightness and commanded brightness is applied to the inverting input of a high gain differential amplifier 198, having an RC feedback circuit 200 connected between its output and its inverting input. Output of the amplifier 198 provides an intensity control signal on an output line 202, which is fed to the arc lamp power supply, such as power supply 82 shown in FIG. 3.

Figure 6:
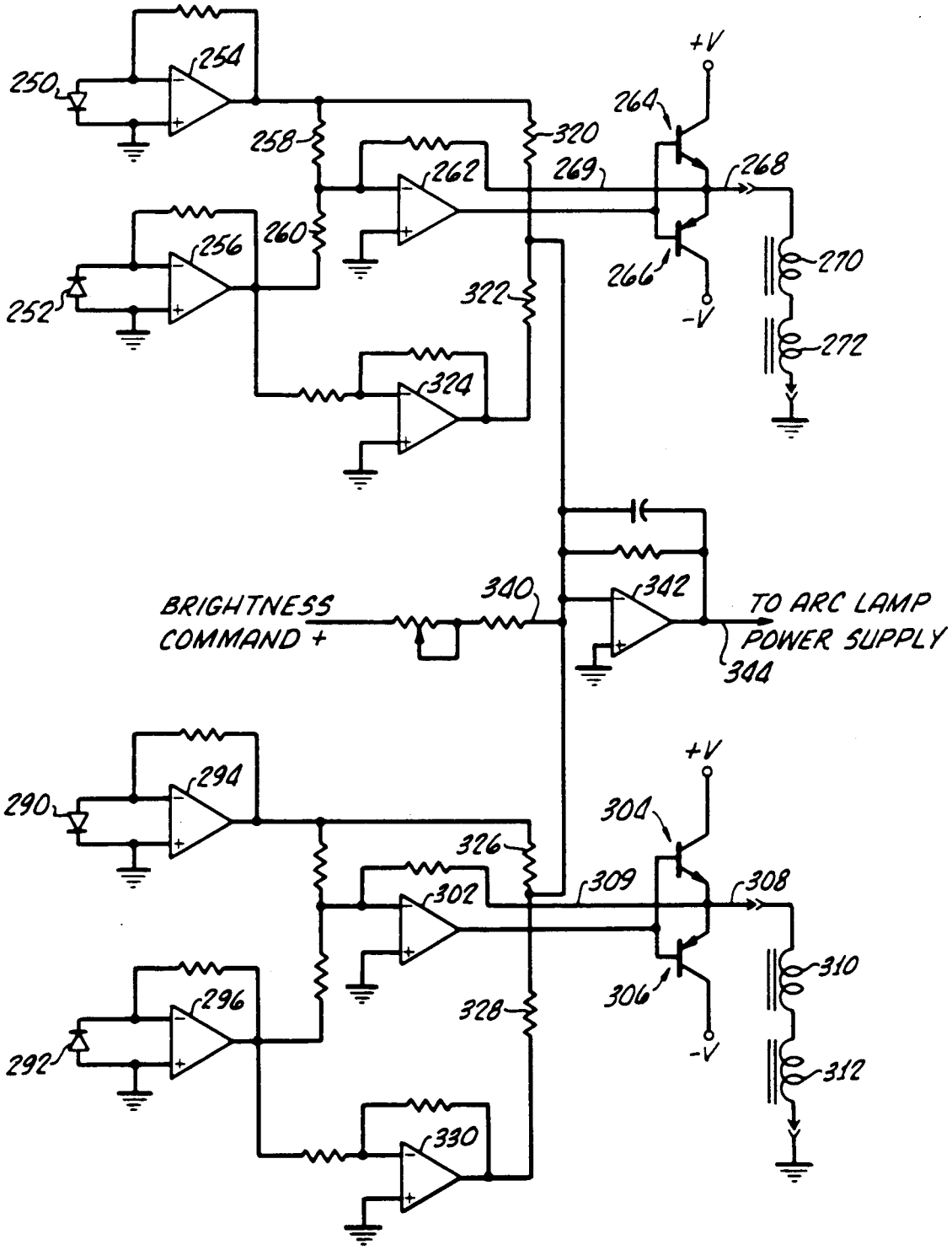
FIG. 6 illustrates a modified circuit for position and intensity control.

In an alternative control circuit arrangement shown in FIG. 6, diodes 250,252 of a first pair of photo diode sensors are positioned to sense infrared illumination of two opposite halves of the arc image. The diodes have their outputs amplified in high gain differential amplifiers 254,256 respectively, having outputs that are differentially combined in a resistor network 258,260, with the combined signal being fed to the inverting input of a high gain differential amplifier 262. The output of amplifier 262 is fed in parallel to the bases of a pair of common emitter transistors 264,266 in a manner similar to that described in connection with FIG. 5*a*, to provide at the common emitter output line 268 a negative feedback signal fed to a first pair of electromagnetic coils 270,272 that are fixedly positioned adjacent the lamp arc. Similarly, a second pair of infrared sensing diodes 290,292 are positioned to sense infrared illumination of two opposite halves of the arc image, but oriented at 90° to the diode pair 250,252. Diodes 290,292 have their outputs amplified in amplifiers 294,296 of which the outputs are differentially combined to be fed to the inverting input of a high gain amplifier 302. The output of amplifier 302 is fed in parallel to the bases of a pair of transistors 304,306, having their emitters coupled together to provide an output on a line 308 which provides a negative arc position feedback to a corresponding pair of electromagnetic coils 310,312. Coils 310,312 are fixedly positioned appropriately adjacent the arc and reflector to move the arc in response to a feedback signal in such a direction as to tend to decrease the sensed arc deflection and to tend to equalize the light received by the two diodes 290,292. In both channels (both axes) of this circuitry an amplifier stabilizing feedback signal is fed from a point in common to the transistor emitters via lines 269 and 309, respectively, to the inverting inputs of the amplifiers 262 and 302, respectively.

Figure 5C:
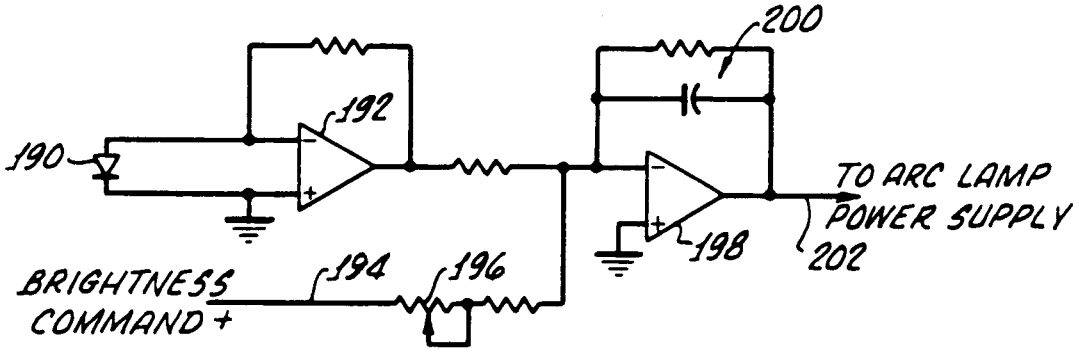
Figure 5B:
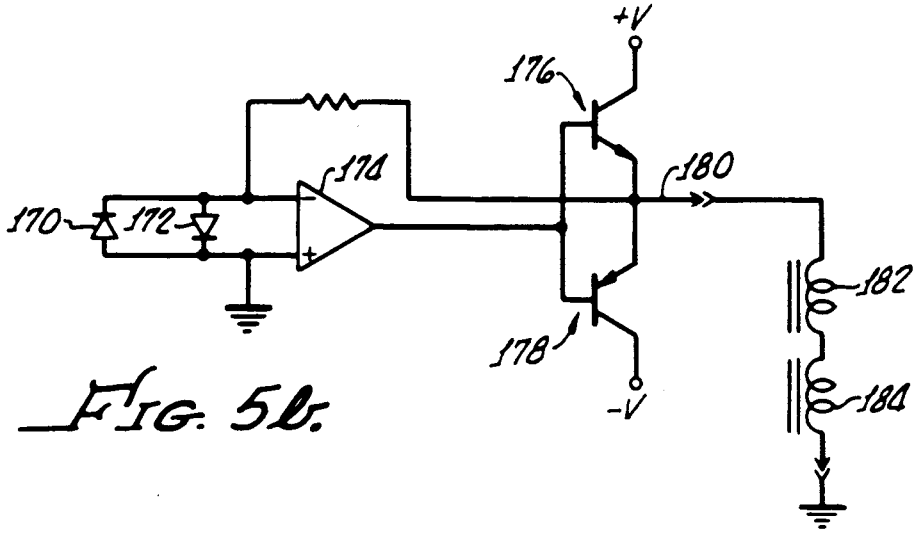

In the arrangement of FIG. 6 a brightness command is obtained not by a separate, independent photo diode sensor, as in FIG. 5*c*, but simply by summing the energy sensed by all four diodes Thus the outputs of diodes 250 and 252 are combined in a resistor network 320,322, with the latter being fed from an amplifier 324 which receives the output of amplifier 256. Similarly the outputs of photo diodes 290,292 are combined via a resistor network 326,328, with the input to the latter being received from an amplifier 330, having its inverting input connected to the amplifier 296. The combined signals at resistor summing network 320,322 and resistor summing network 326,328 are themselves combined with each other and with a brightness command signal on an input control line 340 to provide a brightness control signal via a differential amplifier 342 to a brightness control line 344 which is connected to the power supply, such as power supply 82 of the arc lamp.

Amplifiers 262 and 302 can be operated alternatively in either of two modes. The first is with enough negative feedback provided on lines 269 and 309, respectively, to provide phase and gain margins for a stable DC output. The second mode is without any gain reducing feedback, that is, without the presence of feedback lines 269 and 309, thus resulting in higher gain and oscillation of the optical magnetic loop. As long as the oscillation frequency is high compared with the observing eye bandwidth and the amplitude is small to prevent loss of light from the arc spreading, the second mode (that is without gain reducing feedback) also gives good low frequency arc stability. Random dynamic arc wander has a frequency of about ten to twenty cycles per second or less. Thus the feedback circuitry is chosen to have a sufficiently large bandwidth, of between about eighty and one hundred cycles per second, and to have a high gain at the highest expected wander frequency.

The brightness control signal on line 202 of FIG. 5*c* or line 344 of FIG. 6 may be employed in known arrangements for changing power supplied to the arc. The brightness control signal, for example, may be used to change the duty cycle of a pulse width modulated power supply which supplies current to the arc lamp, or to control the current output of a linear power supply.

In tests of the invention having arc position stabilization circuitry as illustrated in FIG. 2, it was found that arc wander was reduced by a factor of ten on one axis and a factor of thirty on the other axis. This reduction in arc wander made distracting intensity pattern variations imperceptible. The position stabilization circuitry, which minimizes arc wander, also enabled operation of the arc lamp at much larger tilt angles than could be utilized without stabilization. The arc lamp is generally used with its axis horizontal or vertical. For a horizontal lamp, for example, if the lamp axis is tilted more than about 10° from the horizontal, arc wander increases significantly, possibly due to convection currents of the gas in the lamp envelope However, with use of the arc position stabilization described herein, the lamp axis tilt can be increased considerably, to 15° or more, without experiencing unacceptable arc wander.

Use of the present invention enables the arc position on the lamp to be maintained substantially on the lamp axis, namely the line from the cathode to the anode, without any significant or noticeable wander. Furthermore, the invention allows the lamp cathode to be designed with a blunter tip, that is, the cathode may be made initially with a less pointed configuration. This blunter tip results in less cathode burnback, since it is the sharp point of the cathode that is most highly subject to such burnback. Thus when the cathode is designed for an arc lamp employing the described stabilization, it could be provided initially with a less pointed tip. This causes the lamp to provide a more nearly constant light output and a more nearly constant arc position over the life of the lamp, at least partly because a blunt tip will experience less burnback Use of the described techniques will lengthen lamp life because current density and temperature of the initially blunter cathode will change less in a given length of time, allowing more nearly optimum cathode temperature. Lamp life, often measured in terms of a minimum target illumination, is also improved because axial arc movement, which occurs as the cathode burns back, will be less with a blunt cathode, resulting in more effective reflector utilization for a greater time.

As previously mentioned, many different configurations and arrangements may be employed to detect arc displacement for use in accordance with principles of the present invention. Various arrangements are available to obtain an arc image, in addition to the arrangements described above. One possible alternate arrangement for obtaining an arc image does not employ a dichroic cold mirror but employs the full spectrum of radiation emitted by the arc. In such an alternate configuration two separate arc images would be obtained, one indicating displacement in one transverse direction, and the other indicating displacement in a transverse direction at right angles to the first. Thus a pair of small apertures, or even pinholes (not shown), may be formed in reflector 20 (FIG. 1) spaced 90° from one another along a circle defined by intersection with reflector 20 of a plane perpendicular to the axis of the reflector and arc and containing the tip of the cathode. Thus two images of the arc are obtained by mutually orthogonal projections. Sensed displacement of each of these images will provide a feedback signal by means of circuitry that may be identical to that previously disclosed for energization of appropriate pairs of electromagnetic coils. Each of the two orthogonal images has a pair of individual photo diode sensors, the outputs of which are differentially combined to represent displacement in one of two mutually orthogonal directions. Such additional apertures in reflector 20, each having a diameter of about 1/16th of an inch or less, will cause little loss of light because of the small size of the apertures, and suitable lenses may be employed to properly focus the resulting images. Alternatively, the holes in the reflector may be made small enough to act as pinholes, thus obviating need for additional elements to focus the arc images.

What is claimed is:

1. A method of generating a deflection stabilized arc comprising the steps of:

creating an electric arc extending in a first direction from a first electrode to a second electrode, said arc radiating electromagnetic energy;

transmitting energy radiated from said arc to a reflector;

reflecting energy within a band of visible wavelengths from said reflector to an area to be illuminated by the arc;

transmitting energy form said arc to an image forming surface to produce an image of said arc;

sensing position of said image with respect to said surface; and displacing the arc relative to said first electrode in accordance with sensed image displacement and in a sense to decrease sensed image displacement, said step of transmitting energy to an image forming surface comprising transmitting energy within a band of wavelengths that is at least partly outside of said band of visible wavelengths through said reflector.

2. The method of claim 1 wherein said step of sensing position of the image comprises the steps of sensing intensity of illumination of first and second portions of the image forming surface to derive a displacement signal, and wherein said step of displacing the arc comprises the steps of employing the displacement signal to generate a magnetic field adjacent the arc, and applying the magnetic field to the arc so as to decrease sensed displacement of the arc.

3. A method of generating a deflection stabilized arc comprising the steps of:

creating an electric arc extending in a first direction from a first electrode to a second electrode, said arc radiating electromagnetic energy;

transmitting energy radiated from said arc to a reflector;

reflecting visible energy form the arc from said reflector to an area to be illuminated by the arc;

transmitting energy from said arc to an image forming surface to produce an image of said arc;

sensing position of said image with respect to said surface; and displacing the arc relative to said first electrode in accordance with sensed image displacement and in a sense to decrease sensed image displacement, said step of transmitting energy to an image forming surface comprising transmitting infrared energy from the arc through said reflector.

4. The method of claim 3 including the steps of supplying electric power to the electrodes, and sensing intensity of said image to control power supplied to the electrodes so as to decrease variation in intensity of the arc.

5. An arc lamp comprising:

a cathode and an anode defining a pair of arc forming electrodes;

a first reflector positioned adjacent the electrodes;

means for energizing said cathode and anode to generate an energy radiating electric arc extending from a tip of the cathode to the anode, said cathode tip being relatively blunt, whereby cathode burn back is decreased and tendency of the arc to wander over the blunt cathode tip is increased;

a second reflector for reflecting energy from said first reflector to an area to be illuminated, said second reflector being transparent to energy emitted by the arc in selected wavelengths, an image forming surface, image forming means positioned between the second reflector and said surface and responsive to energy in said selected wavelengths for forming an image on said surface on said first reflector, said arc and said electrodes;

detector means for sensing position of the image relative to said surface; and means responsive to said detector means for deflecting the arc in a sense to decrease wander of the arc over said blunt tip.

6. The lamp of claim 5 wherein said means for sensing position of the image comprises a pair of energy intensity detectors configured for detecting intensity of the arc energy in said selected wavelengths at first and second parts of said image and for generating a feedback signal indicative of sensed arc displacement, and wherein said means for deflecting said arc comprises first and second electromagnetic means responsive to said feedback signal for applying a magnetic field to the arc in a direction tending to decrease displacement of the arc from a nominal position.

7. The arc lamp of claim 5 wherein detector means comprises first and second photo diode means for sensing energy intensity of first and second oppositely disposed parts of said image respectively to generate first and second intensity signals, means for differentially combining said intensity signals to generate a feedback signal, said means for deflecting the arc comprising magnetic means positioned adjacent the arc and responsive to said feedback signal for generating a magnetic field having a sense tending to decrease displacement of the arc from a nominal position.

8. The arc lamp of claim 7 wherein said image forming means comprises a plate having an image forming pinhole, said plate being opaque to energy in said selected wavelengths.

9. The arc lamp of claim 7 including means for additively combining said intensity signals to generate an intensity control signal for use in controlling variation in intensity of said arc.

10. The arc lamp of claim 7 wherein said means for differentially combining said intensity signals comprises a differential amplifier having inputs connected to receive said intensity signals, and having an output, transistor means responsive to said amplifier output for energizing said magnetic means, and means for feeding a stabilizing signal from said transistor means to said differential amplifier.

* * * * *